United States Patent [19]

Pierce

[11] Patent Number: 4,619,194

[45] Date of Patent: Oct. 28, 1986

[54] APPARATUS FOR DEWATERING FIBROUS MATERIALS

[76] Inventor: William G. Pierce, 4613 Socialville-Foster Rd., Mason, Ohio 45040

[21] Appl. No.: 591,514

[22] Filed: Apr. 3, 1984

[51] Int. Cl.[4] ..... B30B 9/06

[52] U.S. Cl. ..... 100/127; 100/48; 100/95; 100/249; 100/269 B; 100/906

[58] Field of Search ..... 100/116, 125, 126, 127, 100/95, 209, 218, 249, 256, 906, 48, 50, 269 R, 269 B

[56] References Cited

U.S. PATENT DOCUMENTS 665,973 1/1901 Patterson ..... 100/906 X 2,537,920 1/1951 Smith ..... 100/249

3,434,392 3/1969 Landers ..... 100/249

4,421,022 12/1983 Burgin ..... 100/127 X

*Primary Examiner*—Peter Feldman

*Attorney, Agent, or Firm*—Wood, Herron & Evans

[57] ABSTRACT

In the dewatering press of this invention, a ram, movable in a horizontal plane by hydraulic means, compresses a slurry in a compression chamber which includes as one wall a stop gate assembly movable in a vertical plane and as another wall a self-cleaning screen. After compression in a first direction is completed the direction of the ram's travel is reversed and compression in an opposed, but structurally identical, compression chamber takes place.

8 Claims, 9 Drawing Figures

APPARATUS FOR DEWATERING FIBROUS MATERIALS

BACKGROUND OF THE INVENTION

The dewatering of fibrous materials is commonplace in industry. For example, in the art of paper making, fibrous pulp must be dewatered before it is processed into its final form. In many instances the dewatered pulp is shipped after dewatering and stored until such time as it is used. The degree of moisture retention in the dewatered pulp affects the utility as well as the economics of the process. In storage, the pulp is subject to bacterial degradation. The rate of such degradation increases with increased moisture content. And, an increase in moisture content increases the cost of shipping the dewatered material.

For these reasons and others, it has been the objective of prior art inventors to provide dewatering methods and apparatus that will reduce the water content to the greatest extent possible. Whereas, commonly used methods such as screw presses, revolving discs, V-presses or roll type presses can dewater to a presscake with 60 to 70 percent moisture, it is highly desirable to obtain a presscake with 30 to 40 percent moisture.

The characteristics of moisture release from fibrous materials are not like granular material because of the matting action of the fibers, the resilience of the mat formed, the retention of moisture in the soft porous structure of the fibers themselves, and the trapping of fines and material other than fibers in the mat.

While I do not necessarily mean to be bound by any theory as to why the herein described method and apparatus are successful, it is believed that the following theories explain such success.

I believe the general factors which affect the degree of moisture released are: (1) pressure must be applied sufficient to reduce volume of the matted material to the necessary degree; (2) pressure must be applied in a manner to avoid or reduce thrust on screens; (3) the travel path of moisture must be reduced by thin cross-section of material and close spacing of openings in screen; and (4) sufficient time for moisture travel must result from press action.

In U.S. Pat. No. 3,863,559, incorporated by reference herein, there is disclosed a method for dewatering a presscake to 30 to 40 percent moisture. The method in terms of certain process conditions including:

(1) pressure applied parallel to the screen surface;

(2) a compression rate that begins at about 8 feet per minute and which is reduced to 2 feet per minute toward the end of the cycle;

(3) 300–3,000 psi pressure applied to the presscake and a uniform thin cross-sectional area, about ½ to ¾ inch.

The patent also describes an apparatus for practicing the method.

The press as hereinafter described is adapted to practice the method of U.S. Pat. No. 3,863,559, although other methods may also be practiced with it, and is designed to be an improvement over the apparatus of the U.S. Pat. No. 3,863,559.

SUMMARY OF THE INVENTION

A dewatering press is provided wherein a ram is movable in a horizontal plane in a forward and rearward direction. The ram carries a compression bar and a self cleaning screen through which removed water passes. The ram is driven in a first direction by hydraulic means. The compression bar compresses material to be dewatered against a stop gate assembly. After the material has been dewatered, the stop gate assembly raised, and the presscake is ejected, the hydraulic means reverses the travel of the ram. The ram, traveling then in a direction opposite to the first direction, carries another charge of material to be dewatered against another stop gate assembly whereat another pressing operation takes place. As in the first described stroke, after the pressing operation is complete, the stop gate assembly is raised, the presscake is ejected and the travel of the ram is reversed starting another cycle. Working with the stop gate assembly are knife gates which cut off the presscake after it is formed and the stop assembly is raised. The knife gates scrape off the presscake after the ram reverses its cycle.

DETAILED DESCRIPTION

Figure 1:
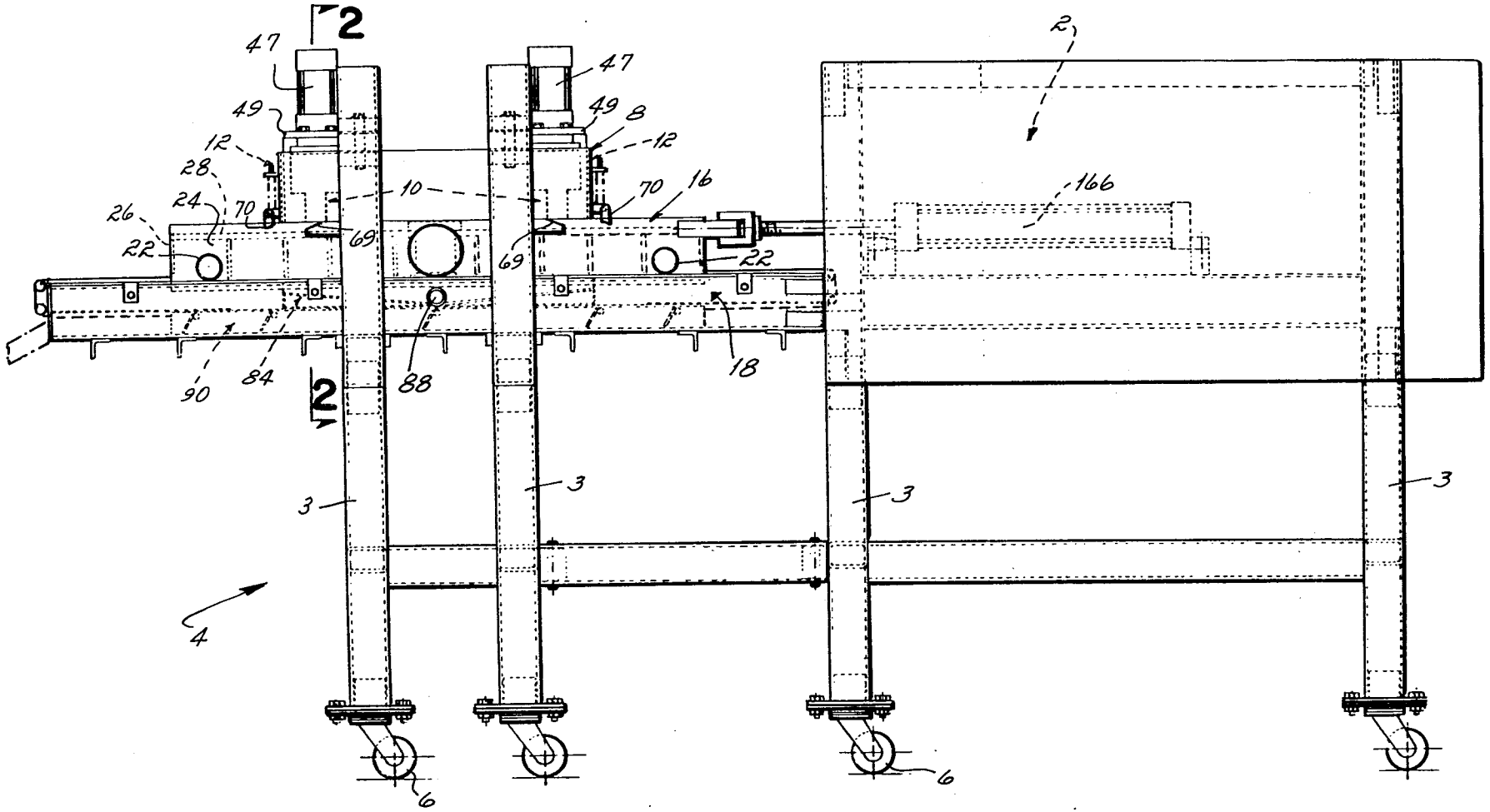
FIG. 1 is a side elevational view of the dewatering press of this invention.

Referring to FIG. 1, the dewatering press of the present invention will be described in more detail. To the right of the drawing is generally shown the hydraulic means 2 which will be described in more detail hereinafter. The hydraulic means is affixed to a frame depicted generally by the number 4. The frame may be mounted on rollers 6 so that the press may be moved. The frame is preferably rectangular in form and includes a suitable number of vertical members 3 for securing to the frame 4 the hydraulic means 2 and a top 8 which carries stop gate assemblies 10 (see also FIG. 4) described in more detail hereinafter, and knife gates 12 (see also FIG. 4) described also in more detail hereinafter. The top 8 is also rectangular in cross section. During the pressing operation it remains in a fixed relationship with respect to the vertical numbers 3.

Figure 2:
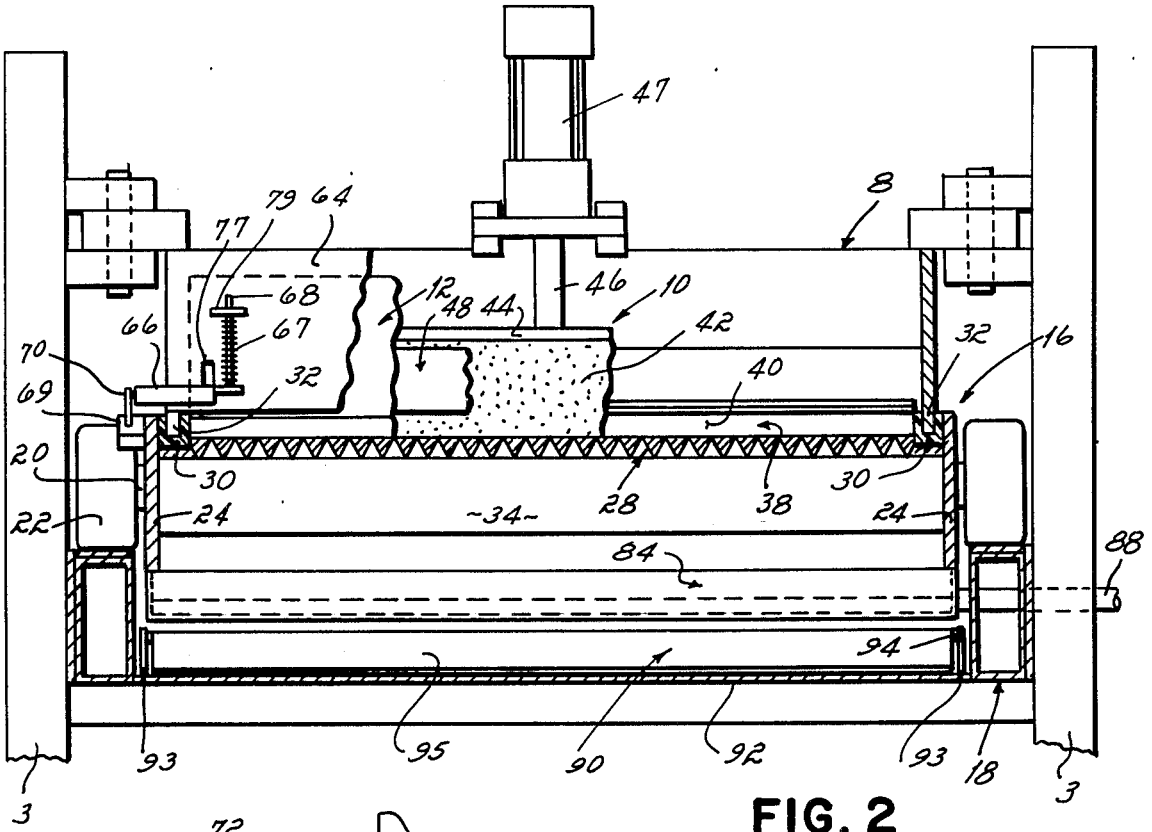
FIG. 2 is a cross sectional view of the press taken generally along the line 2—2 of FIG. 1.

A horizontal runway for a ram 16 is provided by horizontal frame members 18. Axles 20 carrying rollers 22 are affixed to the ram 16. As shown in FIG. 2, the rollers 22 ride on the horizontal frame numbers 18.

The ram 16 comprises side walls 24 and end walls 26. The top wall of the ram 16 comprises a self cleaning screen 28. It may be permanently secured to the side walls 24 and end walls 26 by any suitable means such as by welding. Adjacent to the side walls 24, and parallel with the side walls 24 are U-shaped plastic channels 30 that embrace the depending side walls 32 of the top 8. These channels 30 serve to insure that the ram 16 travels in a straight direction and to seal the press during operation. They are also used to provide a low friction replaceable wear strip. They are preferably made from ultra high molecular weight polyethylene. Extending between the side walls 24 of the ram are traverse bracing members 34. These serve to support the self cleaning screen 28. As shown for example, i.e., FIG. 5, preferably these members 34 are spaced more closely together toward the inside of the ram adjacent the intermediate walls 36 where the compression chambers, described below are located. A compression bar 38 is mounted between the walls 36 and extends between the sidewalls 24 of the ram 16.

The compression bar 38 is T-shaped in cross section and includes compression surfaces 40 that extend approximately ½ to ¾ of an inch above the self cleaning screen 28. The compression bar 38 is affixed to the ram 16 by the axles of the center rollers 22. The axles are inserted through a bored hole in the side frames 24 and are threaded into the compression bar.

Figure 4:
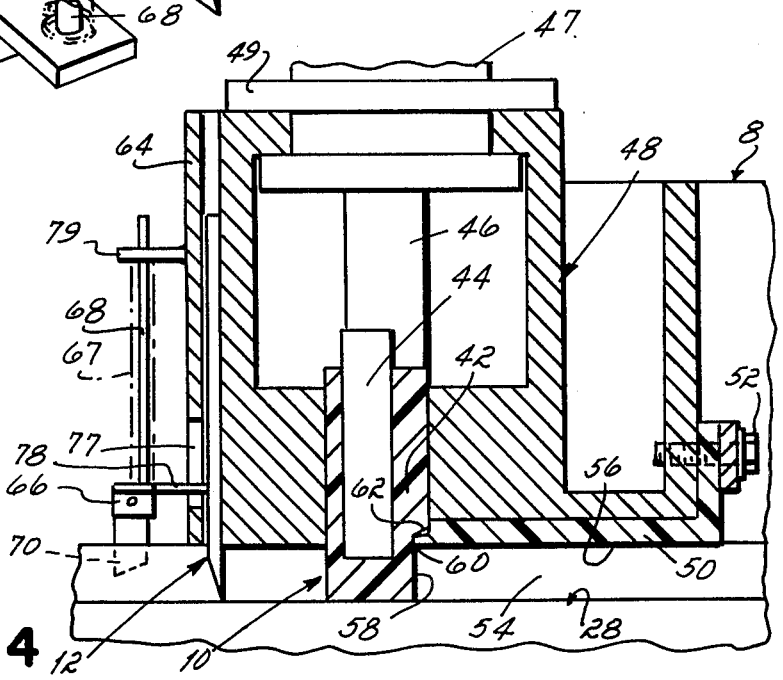
FIG. 4 is a cross-sectional view showing a stop gate assembly and a knife gate.

As noted earlier the top 8 includes two stop gate assemblies 10. Referring to FIG. 4 a typical stop gate assembly 10 may be seen in more detail. It includes a plastic compression channel member 42 that extends across the width of the top 8. It may be made from a low friction replaceable plastic material such as ultra molecular weight polyethylene. It is secured to a metal bar 44 that in turn is secured by means not shown to a piston rod 46. The top 8 has a cross block member 48 which serves as a mount for a hydraulic cylinder 47 that reciprocates its piston rod 46 to raise and lower the stop gate assembly 10. The block 48 also serves as a guide for the gate assembly 10 and provides a place to affix a compression wear plate 50 to, as for example, by means of bolts 52. The compression wear plate 50 is made of a low friction replaceable plastic material such a ultra high molecular weight polyethylene. The area below the compression wear plate, which can be termed a compression chamber, is designated generally by the number 54. The distance between the bottom 56 of the compression wear plate 50 and the self cleaning screen 28 is slightly greater than the ½ to ¾" dimension of the compression bars 38 so that the compression surface 40 of a compression bar 38 may pass between the bottom 56 and the top of surface 28. When the stop gate assembly 10 is in its lowermost position as is shown in FIG. 4, the stop gate presents a vertical surface 58, this surface being one wall of the compression chamber 54. In other words, a compression chamber 54 is defined by the stop gate compression surface 58, the self cleaning screen 28, the compression surface 40, the compression wear plate bottom 56, and U-shaped plastic channels 30 on the side walls 24.

The compression wear plate includes a forward sealing tip 60 forming a means for engaging and sealing with respect to the plastic channel member 42. Preferably the sealing tip 60 is tapered downwardly toward the screen 28 and designed so as to sealably engage an angled surface 62 of the plastic channel member 42 to provide a relatively water tight, frictional seal between the two. More particularly, complementing angles or sealing surfaces are avoided so that line contact is made across the seal as opposed to a surface contact which tends to produce irregularities.

The cross block member 48 also guide the knife gates 12, one knife gate 12 positioned at one end of the top 8 and the other to the other end.

Figure 3:
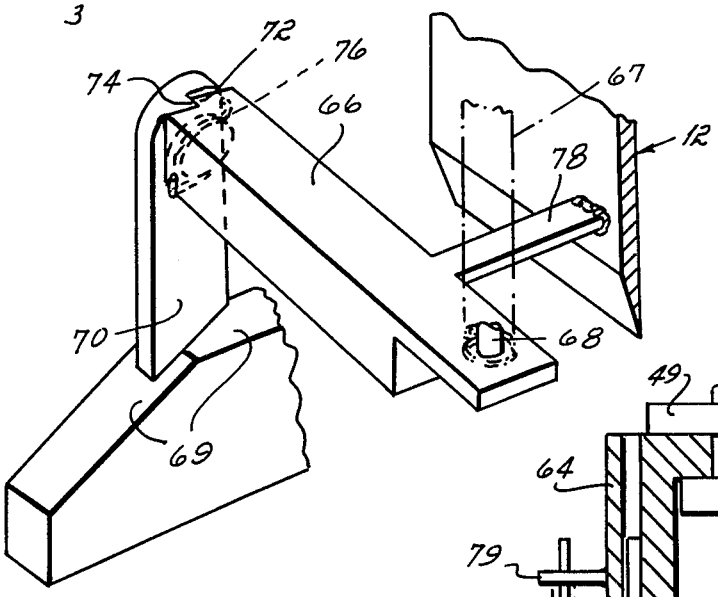
FIG. 3 is a perspective view of the mounting mechanism and cam assembly that carries each knife gate.

Knife gate securing bars 64 are parallel to the cross block members 48 and spaced apart a distance slightly greater than the thickness of the knife gates 12. The bars 64 are secured to the cross block members by spacers and welds (not shown). In FIG. 3 an actuator for a knife gate assembly 12 is shown in more detail. A mounting bar 66 welded to the knife gate 12 also includes a spring 67 and a rod 68 attached thereto and a cam bar 70 that is pivotably secured to the bar 66. A detent 72, stop 74, and spring 76 permits the cam bar to rotate in one direction where a force is applied and to be returned to the position shown in FIG. 3 when the force is removed. The mounting bar 66 attaches to the knife gate 12 by a web 78, the web extending through a slot 77 in the bar 64. (See FIGS. 2–4). In an alternative embodiment, not shown, the knife gate spring 67 can be held fixed on rod 68 between an extended bar 49 and a lug, not shown, mounted on knife gate 12.

As shown in FIGS. 2, and 4, a bracket 79 is secured to the knife gate securing bars 64 as for example by welding. The bars 64 include vertical slots 77, which receive the webs 78. The knife gate assemblies may thus move upwardly from the position shown in FIG. 4.

The cross block members 48 also serve to form two of the walls for a feedstock chamber 80, the other two walls 32 of which are the side walls of the top 8. The opening of the chamber 80 is such that it is large enough to prevent "bridging" of the material (slurry) contained therein.

Horizontal frame members 18 also serve to support an effluent pan 84 that is secured to the frame members 18 beneath the self cleaning screen 28. The pan 84 has sloping bottom walls 86 and a drain hole 88 out of which the effluent may exit after it has been pressed from the feedstock.

As best seen in FIGS. 2 and 5A–5D, a discharge conveyor 90 is provided to convey the dewatered presscake from the press to a discharge chute 99. Although the drawings depict a compressed slug 91 on the floor 92 below the conveyor 90 it is to be understood that the dewatered presscake discharged from the compression chamber may take forms varying from the slugs to piles of dewatered fibre.

The conveyor 90 is reciprocable beneath the compression chambers 54 and is operable to discharge the dewatered presscake in one direction only. To this end, the conveyor comprises a pair of side rails 93 joined by a plurality of shafts 94. Each shaft 94 is mounted in rails 93 to rotate freely in suitable bearings (not shown) and each shaft 94 has affixed thereto a pusher 95. At each end, the rails 93 have a cable 96 attached thereto, the cable being trained around pulleys 97,98. The cable has its opposite end secured to end wall 26 of ram 16. Thus the secured cables 96, conveyor 90 and ram 16 constitute a closed loop and hence are effective to translate the conveyor as the ram 16 is reciprocated by hydraulic means 2.

Figure 5A:
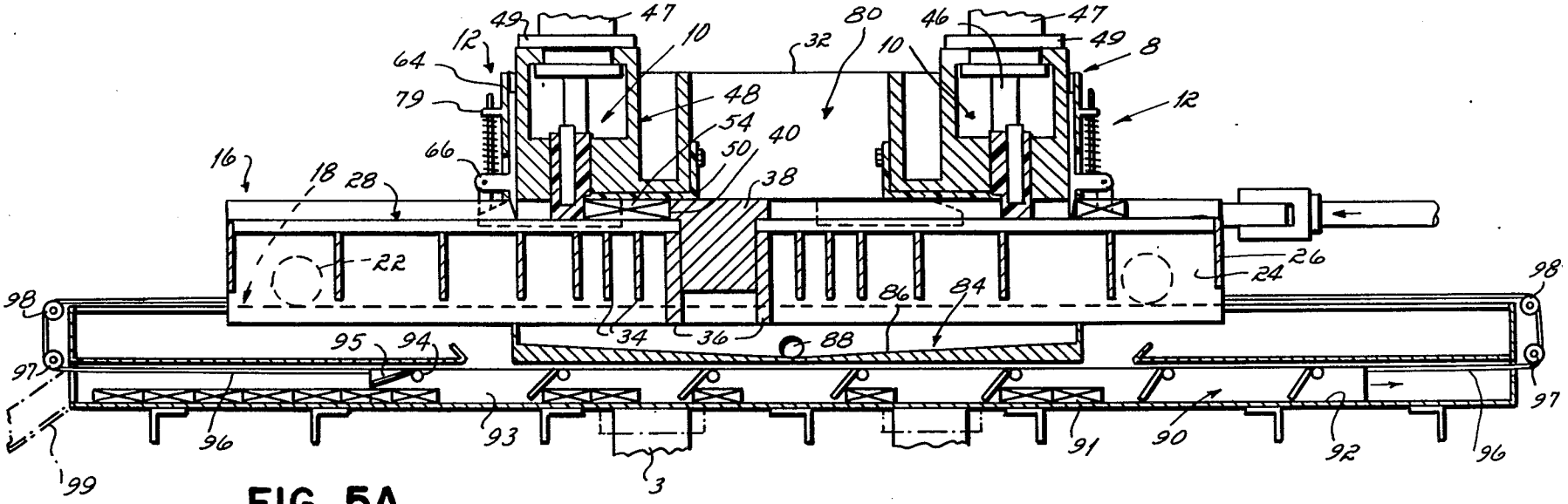
FIG. 5A is a sectional view of the press beginning a stroke which direction is indicated by the arrow.
Figure 5B:
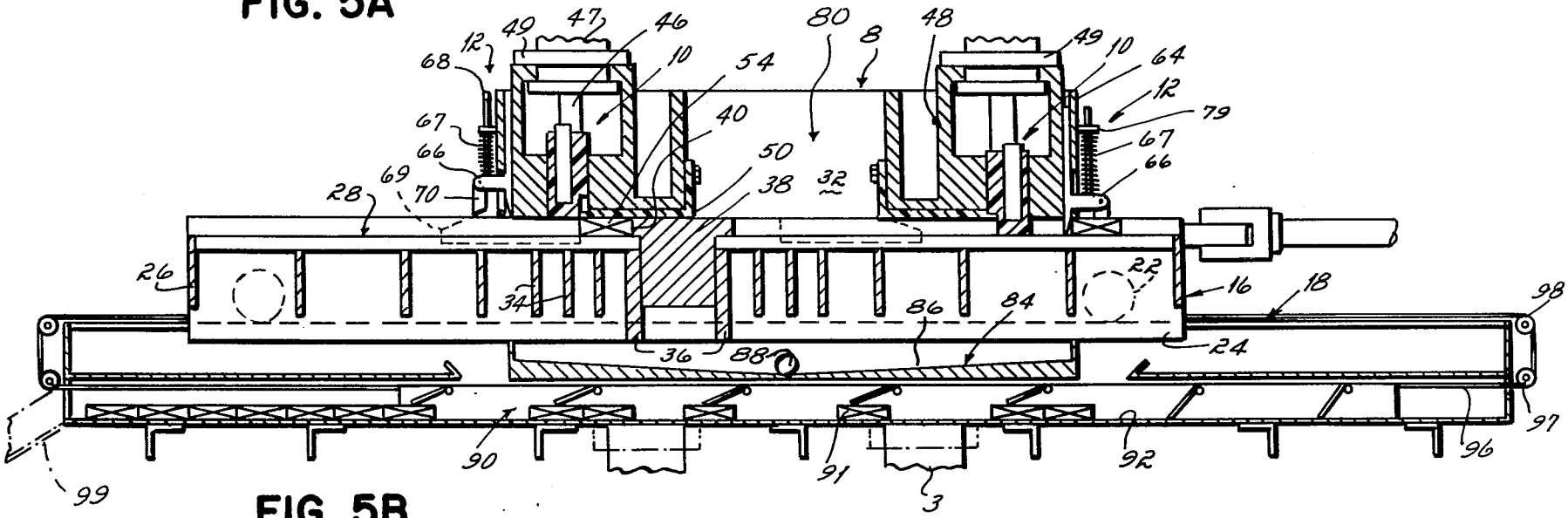
FIG. 5B is a sectional view of the press after it has completed a compression stroke and the stop gate assembly has lifted.
Figure 5C:
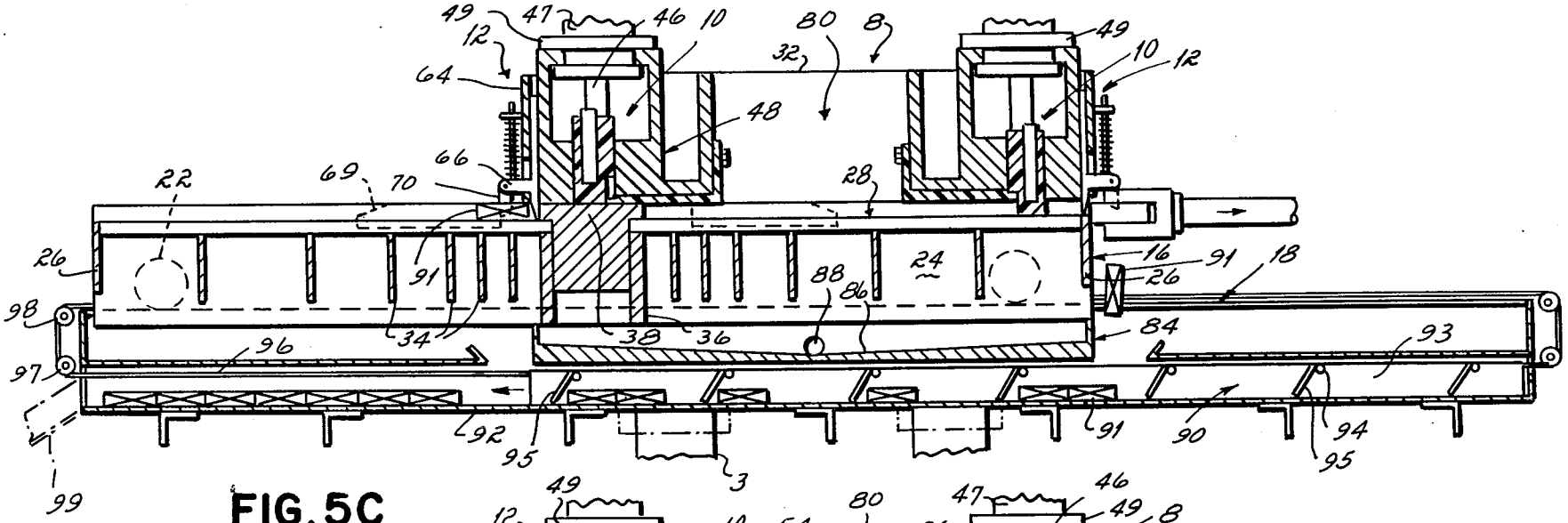
FIG. 5C is a sectional view showing the press beginning to reverse its direction of travel, shown by the arrow, so as to begin another compression stroke in a direction that is opposite to the one that is shown in FIG. 5A.
Figure 5D:
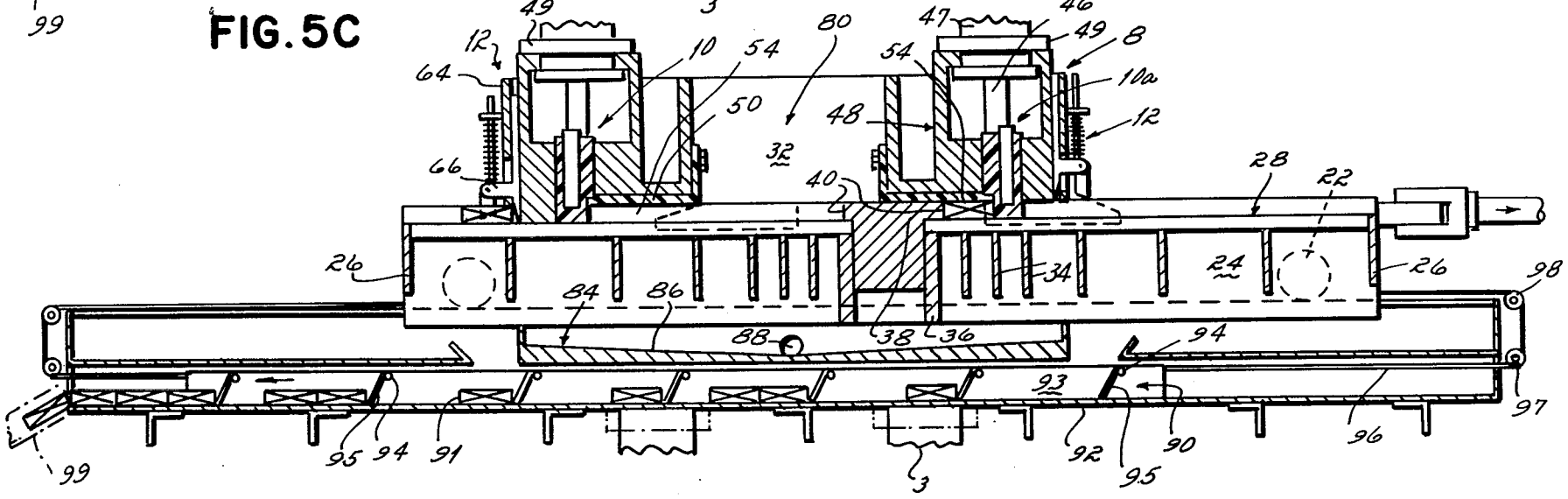
FIG. 5D is a sectional view showing the press at the end of the compression stroke that began in FIG. 5 with the stop gate assembly in the raised position.

Referring specifically to FIG. 5A it can be seen that the conveyor 90 translates to the right as the ram 16 moves to the left. During this movement of the conveyor 90, the conveyor is ineffective because the freely rotating shafts 94 permit their pushers 95 to swing up and drag over the top surface of the dewatered presscake. Conversely, and as seen in FIG. 5D, as the conveyor moves toward discharge chute 99 the pusher engages and conveys the dewatered presscake along the floor 92 toward the chute.

It is to be noted that shaft 94 is spaced above floor 92 a distance that is less than the height of pusher 95. This dimensional relationship precludes the pusher from swinging beyond vertical and dragging along the top surface of the dewatered presscake as was possible when the conveyor was being translated in its "non-conveying" direction.

Figure 6:
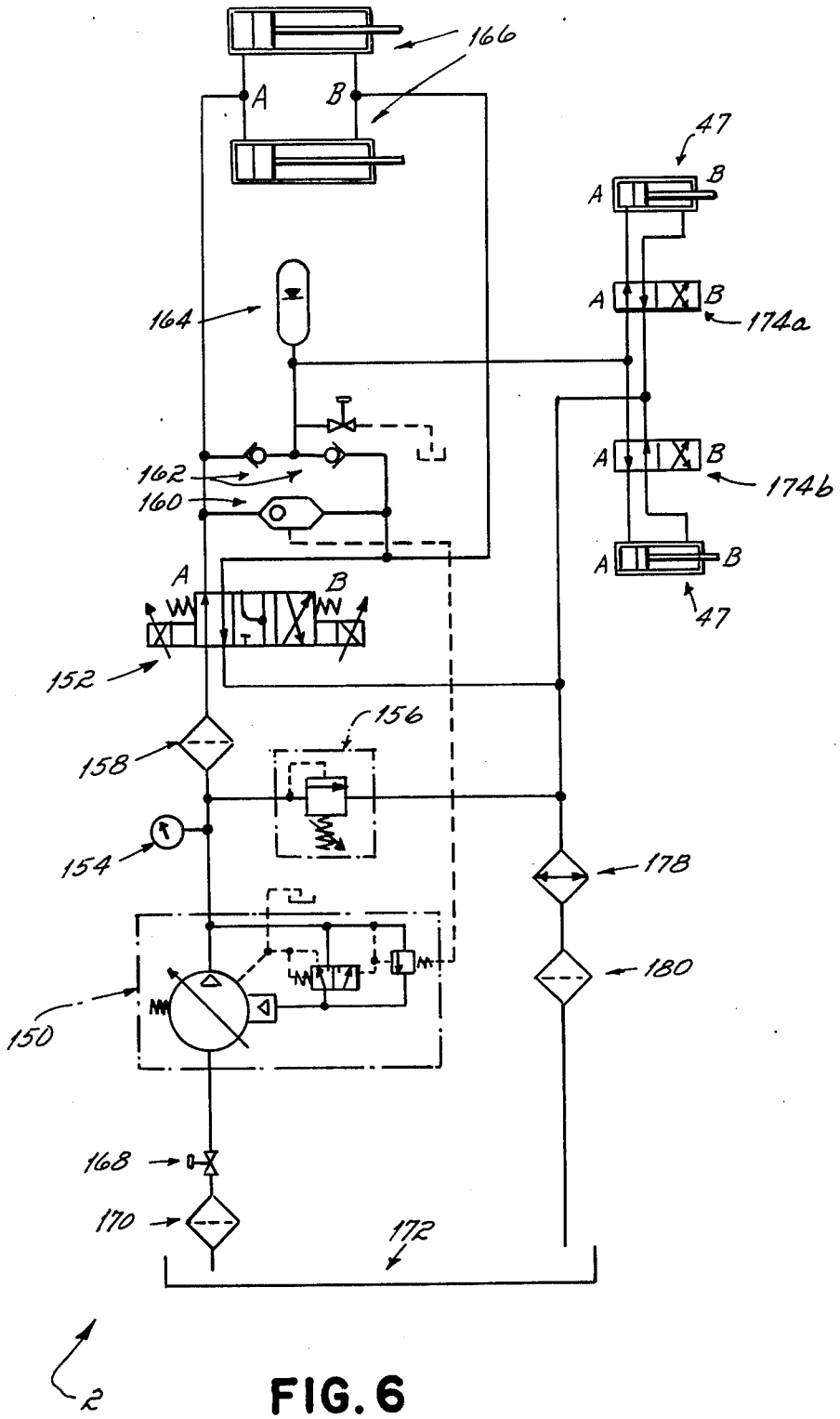
FIG. 6 is a schematic diagram of the hydraulic system used in the press.

Referring to FIG. 6 the hydraulic system will now be described in conjunction with FIGS. 5A–5D.

The hydraulic system supplies the power for the dewatering process in the press. Consequently, the system must first and foremost control the speed of the compression to meet the requirements set forth in U.S. Pat. No. 3,863,559. Secondly, the system must be capable of self-throttling to minimize the power consumption required for the press.

The drive sequence requires two primary steps. First, low pressure/high flow to maximize the capacity of the press by feeding the compression area quickly by the use of a high ram speed. Second, high pressure/low flow which is required to push the ram with sufficient force to reduce the volume of material to a degree necessary for elimination of excessive moisture content, and low flow to slow down the speed of compression to allow for sufficient time for moisture travel out of the soft porous structure of fibrous material.

By providing a drive system that is self-throttling the power package will consume merely enough energy to provide either low pressure/high flow or high pressure/low flow. Never will there be a need to supply sufficient power for a high pressure/high flow system which would be necessary without the throttling capabilities, resulting in as much as an 85% energy savings during mechanical dewatering.

The main components of the hydraulic system that allow for the amount of control that is required are a "load sensing" variable volume hydraulic pump 150 and a directional flow control valve 152. Suitable valves are manufactured and sold by Towler Hydraulics, Inc. of Urbana, Ohio under its model number WPL43. A suitable pump is manufactured by Hydura Products, Milwaukee, Wis., under its trademark "CF Load Sensing Control". The load sensing control in the pump maintains constant flow irrespective of working pressure. As load on the system increases, the pump pressure will also increase with the flow remaining constant. However, the pump will monitor the differential pressure across an orifice. When the pressure drop exceeds a preset valve the pump will destroke and reduce the volume to bring the pressure deop down to the desired level. The orifice that the pump monitors is a proportional solenoid pilot operated directional/flow control valve which will vary the flow of hydraulic oil with respect to electrical input signals. The electrical signals will vary depending on the position of the ram during the stroking sequence in accordance to the optimum speeds that were developed for the specific material being dewatered.

In combination with the pump 150 and the directional flow control valve 152 are the following other components. A pressure gauge 154, a pressure relief valve 156, a high pressure filter 158, are incorporated between the valve 152 and pump 150. These are all of conventional design and well known in the industry. A shuttle valve 160, check valves 162, an accumulator 164, also of conventional design, are provided. Ram cylinders 166 operably attached to the ram 16, are also of conventional design.

Shut off valve 168 and suction filter 170 connect the pump 150 with the hydraulic fluid reservoir 172. These are also of conventional design.

Directional valves 174(*a*) and 174(*b*), of conventional design, are operably connected with the stop gate cylinders 47 that are mounted on top of cross block members 48.

A conventional heat exchanger 178 and return filter 180 are also provided.

To follow the operation of the hydraulic system, assume that compression bar 38 is in a center position. The stop gate assemblies 10 are down with the cylinders 47 in the extended position and the directional valves 174*a*, 174*b* in position A. The proportional flow control valve 152 is in the center position with A and B ports of cylinders to tank. The pressure settings (hereinafter P.S.) are as follows:

P.S. (1): The A side of the ram cylinders 166 have a maximum hydraulic pressure setting selected to provide the cylinder force requirements for the type of material being dewatered. The force requirements may vary from 300 psi for spent grain to 3000 psi for paper pulp.

P.S. (2): The B side of the ram cylinders 166 must have a maximum hydraulic pressure setting to correspond to the A side taking into account for the rod cross sectional area of the cylinder vs. the piston.

P.S. (3): The pressure compensator setting of the pump 150 should be approximately 200 psi above the maximum pressure in P.S. (2) and functions to destroke or reduce the flow output should that setting be reached.

P.S. (4): The pressure relief valve 156 is to relieve the system and protect the drive package from over pressurization. Its normal setting should be approximately 100 psi above the pump compensator.

P.S. (5): The accumulator 164 is to be pre-charged with nitrogen gas to a setting of 75% of the maximum hydraulic pressure of P.S. (2).

When the start push button is activated the proportional flow control valve 152 will shift to the A position and the pump 150 will start the flow of hydraulic oil to the A ports of the ram cylinders 166 at low pressure/-high flow and the compression bar 38 will travel at high speed towards the discharge end of the press (FIG. 5A). An electrically operated limit switch activated off of the ram cylinder 166 will register that the leading edge of the compression bar 38 has entered into the compression chamber 54. Immediately the flow control valve 152 will shift to close off the flow and reduce the speed of the ram from 30 fpm to approximately 8 fpm. That will automatically cause the differential pressure across the valve to increase dramatically since the large volume of flow cannot pass through the smaller orifice setting. The pump in turn which monitors the pressure drop across the variable orifice of the control valve 152 will immediately destroke to reduce flow and maintain a fixed 100 psi differential across the valve. As the compression bar 38 travels further into the compression chamber 54, the speed of the ram is ramped down electrically to provide sufficient time for moisture travel as the pressure increases due to the compaction of the material being dewatered. The speed of the cylinders 166 will be ramped down from 8 fpm to 2 fpm by slowly closing the orifice opening in the flow control valve 152 which will constantly increase the pressure drop, resulting in a reduced flow output from the pump 150. As the flow throttling is taking place, the pressure is increasing due to compaction to the point of high pressure/low flow. However, the horsepower requirements will remain somewhat constant to the needs at low pressure/-high flow.

When the degree of compaction has been obtained by reaching the hydraulic pressure setting P.S. 1 the flow control valve 152 will shift to the center position resulting in the dissipation of pressure in the compression area since the A and B ports drain to tank, and the directional valve 174*a* will shift to the B position and cause cylinder 47 to raise the channel member 42.

As cylinder 47 raised the channel member 42, knife gate 12 was raised by cam surface 69 raising cam bar 70, during the compression portion of the stroke. After a short time delay, the flow valve 152 will again shift to the A position to pass maximum flow for maximum ram speed (low pressure/high flow). Another electrically operated limit switch activated by the ram cylinder will register the end of the stroke and cause the flow valve 152 to shift completely to position B causing the ram cylinders to reverse directions and retract at high speed (low pressure/high flow). Instantaneous with the reversal of cylinders 166, the cam bar 70 drops off cam 69 and knife gate 12 is lowered by spring 67 to its blocking position (FIG. 5C). The knife causes the dewatered presscake to be dragged from the screen 28 as the ram 16 is moved by the cylinders 166 in the opposite direction.

The ram will travel at maximum speed towards the drive end as the cylinders retract. As in the sequence for travel in the opposite direction, an electrically operated limit switch activated by the cylinder ram will register that the leading edge of the compression bar 38 has entered into the compression area 54 (FIG. 5D). The sequence of flow and pressure will duplicate that of the opposite direction but will be controlled by the flow control orifice of the valve 152 in the B position at maximum pressure P.S. 2 for the B side of the cylinder 166, and will activate directional valve 174*b* and the other gate assembly 10*b* at the right, as viewed in FIG. 5D.

As the ram 16 operates it serves to cause the conveyor to move the presscakes 91 toward and out of the discharge chute 99.

I claim:

1. A dewatering press comprising in combination, a frame, said frame having horizontal and vertical members, a top, said top attached to said frame, at least two stop gate assemblies mounted to said top, at least two knife gates, a ram, hydraulic means connected to said ram for parallel movement of said ram beneath said top in opposite linear directions, said hydraulic means including a load sensing variable volume pump and a proportional control valve whereby both low pressure/high flow and high pressure/low flow operation may be generated, a compression bar secured to said ram at about the middle of said ram, a self-cleaning screen, said compression bar having opposed compression surfaces that extend approximately $\frac{1}{2}$ to $\frac{3}{4}$ of an inch above the self cleaning screen, means for raising and lowering said stop gate assemblies whereby when a stop gate assembly is in its lowered position it cooperates with said compression bar, self-cleaning screen, the top, and ram, to form a compression chamber, and means for raising and lowering the knife gates.

2. The press of claim 1 wherein said knife gate assemblies are raised and lowered by spring and cam means.

3. The press of claim 2 wherein bracing means are provided below said self-cleaning screen.

4. The press of claim 3 wherein the compression bar is T-shaped in cross sections.

5. The press of claim 4 wherein the top includes compression wear plates having surfaces that engage the gate assemblies when said gate assemblies are within their lowered position.

6. The press of claim 5 wherein a conveyor is disposed beneath the self-cleaning screen.

7. In a dewatering press wherein the material to be dewatered is confined between two surfaces, one constituting a screen, the two surfaces being spaced apart a distance about $\frac{1}{2}$ to $\frac{3}{4}$ of an inch, and the material to be dewatered is pressed by a ram operated by hydraulic means in a direction parallel to the screen at a press rate which decreases as pressure continues, the pressure being asserted on the material being about 300–3,000 psi, the improvement comprising as part of the hydraulic means a load sensing variable volume hydraulic pump and a proportional flow control valve which permits the press to be operated under both low pressure/high flow and high pressure/low flow conditions.

8. The dewatering press of claim 7 wherein the hydraulic means also includes at least one pressure relief valve, at least one shuttle valve, a plurality of check valves, and an accumulator.

* * * * *